US006868591B2

(12) United States Patent
Dingman et al.

(10) Patent No.: US 6,868,591 B2
(45) Date of Patent: Mar. 22, 2005

(54) INFANT BUCKLE

(75) Inventors: Guy R. Dingman, Westfield, IN (US); Gregory L. Woodard, Brownsburg, IN (US); Donald C. Boyle, Indianapolis, IN (US); Michael A. Wiseman, Avon, IN (US)

(73) Assignee: Indiana Mills & Manufacturing, Inc., Westfield, IN (US)

( * ) Notice: Subject to any disclaimer, the term of this patent is extended or adjusted under 35 U.S.C. 154(b) by 0 days.

(21) Appl. No.: 10/612,247

(22) Filed: Jul. 2, 2003

(65) Prior Publication Data

US 2004/0003486 A1 Jan. 8, 2004

Related U.S. Application Data

(60) Provisional application No. 60/393,921, filed on Jul. 5, 2002.

(51) Int. Cl.[7] ..... A44B 11/25; A44B 17/00

(52) U.S. Cl. ..... 24/615; 24/629; 24/633; 297/484

(58) Field of Search ..... 24/633, 629, 615, 24/614; 297/484

(56) References Cited

U.S. PATENT DOCUMENTS

| | | | | |
|---|---|---|---|---|
| 4,385,425 A | | 5/1983 | Tanaka et al. | |
| 5,220,713 A | | 6/1993 | Lane, Jr. et al. | |
| 5,269,051 A | | 12/1993 | McFalls | |
| 5,406,681 A | | 4/1995 | Olson | |
| 5,526,556 A | | 6/1996 | Czank | |
| 5,584,107 A | | 12/1996 | Koyanági et al. | |
| 5,781,971 A | * | 7/1998 | Petersen, III | 24/633 |
| 5,813,097 A | | 9/1998 | Woellert et al. | |
| 5,979,026 A | * | 11/1999 | Anthony | 24/633 |
| 6,588,077 B2 | * | 7/2003 | Katsuyama et al. | 24/633 X |

FOREIGN PATENT DOCUMENTS

| | | |
|---|---|---|
| EP | 0 867 131 A1 | 9/1998 |
| EP | 1 224 880 A1 | 7/2002 |

OTHER PUBLICATIONS

IMMI Brochure entitled "Safeguard™—Buckle Up With Confidence," dated Feb. 2002.

* cited by examiner

*Primary Examiner*—Anthony D Barfield
(74) *Attorney, Agent, or Firm*—Barnes & Thornburg LLP

(57) ABSTRACT

A buckle for use with a safety belt includes a buckle housing formed to define a cavity, an actuator aperture in communication with the cavity, and an insertion opening in communication with the cavity. An actuator of the buckle is coupled to the buckle housing and formed to include a button accessible through the actuator aperture of the buckle housing as well as a belt-anchor catch coupled to the button to move with the button. The buckle further includes an ejector spring positioned within the cavity of the buckle housing along a substantially central longitudinal axis defined to extend from a back end of the buckle housing to a front end of the buckle housing. First and second belt anchors are formed to be inserted, at least in part, into the insertion opening to engage the ejector spring and move the ejector spring to a retracted position.

20 Claims, 7 Drawing Sheets

INFANT BUCKLE

CROSS-REFERENCE TO RELATED APPLICATIONS

This application claims the benefit of and priority to U.S. Provisional Patent Application Ser. No. 60/393,921 filed Jul. 5, 2002, the disclosure of which is hereby incorporated by reference herein.

BACKGROUND

The present disclosure relates to seat buckles for restraining small juveniles within a juvenile vehicle seat.

Various harness-restraint systems are used to restrain a child within a juvenile vehicle seat. Many harness-restraint systems are coupled to the juvenile vehicle seat and may include various shoulder belts or shoulder belt portions which extend over a child's shoulders when restrained within the juvenile vehicle seat, lap belts or lap belt portions which extend over a child's lap when restrained, and/or other belt portions coupled to a seat bottom of the vehicle seat at a location generally between the child's legs. Various such harness-restraint systems also include one or more buckles which are lockable and unlockable by a user to couple one or more of the above belt portions to each other in order to secure or remove a child from within the juvenile vehicle seat.

Features of the disclosure will become apparent to those skilled in the art upon consideration of the following detailed description of the preferred embodiments exemplifying the best mode of carrying out the disclosure as presently perceived.

SUMMARY

According to the present disclosure, an infant buckle is provided for use with a safety belt or a juvenile harness-restraint system of a juvenile vehicle seat having adjustable straps for restraining a child within the seat. Such a juvenile vehicle seat may, without limitation, include an add-on child seat as defined in Federal Motor Vehicle Safety Standards. The infant buckle is movable by a user between a locked position for restraining the child, for example, and an unlocked position for removing the child. The buckle includes a buckle housing, an actuator coupled to the buckle housing, an ejector spring and a locking spring positioned within the buckle housing, and first and second belt anchors formed to be received, at least in part, within the buckle housing.

The buckle housing is formed to define a cavity, an actuator aperture in communication with the cavity, and an insertion opening in communication with the cavity. The actuator is received within the cavity and includes a button accessible through the actuator aperture of the buckle housing and a belt-anchor catch coupled to the button to move with the button. The ejector spring is positioned to lie within the cavity of the buckle housing along a substantially central longitudinal axis defined to extend from a back end of the buckle housing to a front end of the buckle housing. The locking spring is positioned to lie within the cavity of the buckle housing along a transverse axis substantially perpendicular to the longitudinal axis. The locking spring is formed to engage a bottom wall of the buckle housing at a first end and a portion of the belt-anchor catch at a second end to bias the belt-anchor catch in a direction away from the bottom wall of the buckle housing.

In order to place the buckle in the locked position, the first and second belt anchors of the buckle are received into the cavity of the buckle housing in coupled relationship to each other through the insertion opening of the buckle housing. The first belt anchor engages the ejector spring and moves the ejector spring to a retracted position. The second belt anchor is coupled to the first belt anchor and engages the belt-anchor catch of the actuator when inserted into the cavity to move the belt-anchor catch of the actuator against the bias of the locking spring.

BRIEF DESCRIPTION OF THE DRAWINGS

The detailed description particularly refers to the accompanying figures in which.

DETAILED DESCRIPTION OF THE DRAWINGS

An illustrative infant buckle 10 is provided for use with a juvenile vehicle seat (not shown) such as, for example, an add-on child seat, and specifically for use with a juvenile harness-restraint system (not shown) of a juvenile vehicle seat having adjustable straps for restraining a child within the seat. Buckle 10 is movable by a user between a locked position for restraining the child, for example, and an unlocked position for removing the child.

Figure 5:
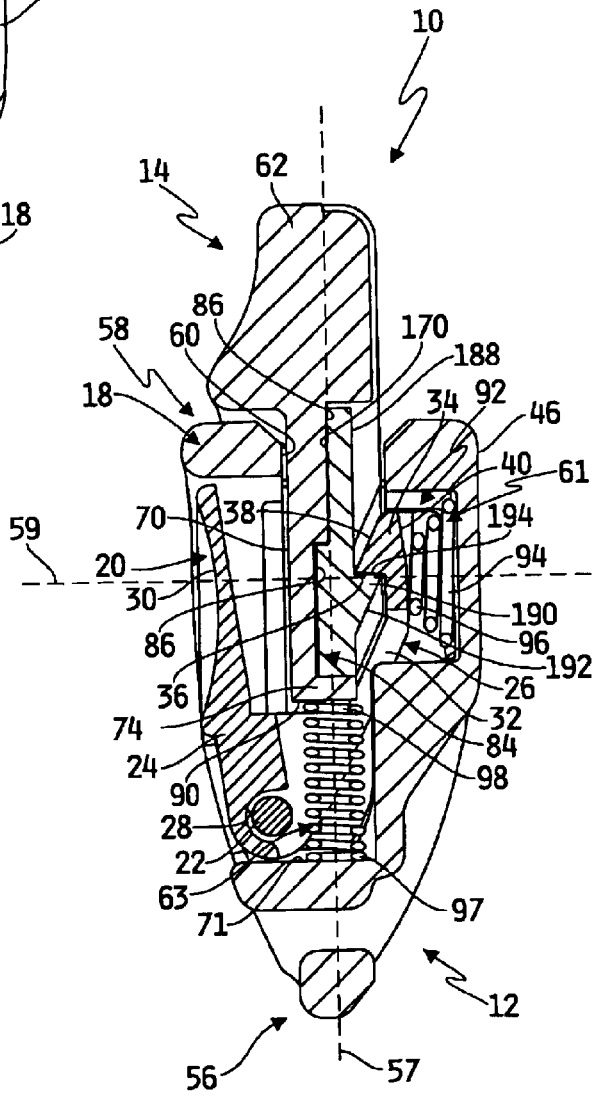
FIG. 5 is a sectional view of the buckle taken along line 5—5 of FIG. 2 showing a first locking and a second ejector compression spring of the buckle.

Illustratively, buckle 10 includes a body 12, a first belt anchor 14, and a second belt anchor 16. As shown in FIG. 5, first and second belt anchors 14, 16 are coupled to each other and to body 12 when buckle 10 is in the locked position. Body 12 includes a buckle housing 18 and an actuator 20 movably coupled to housing 18 by pin 22. Illustratively, pin 22 is press fit through an aperture 52 of housing. However, it is within the scope of this disclosure to movably couple actuator 20 to housing 18 using other suitable fasteners such as screws, rivets, etc. As shown in FIG. 5, actuator 20 includes a button 24 and a belt-anchor catch 26 coupled to button 24. Actuator 20 further includes an aperture 28 for receiving at least a portion of pin 22 therein. Button 24 includes an indented upper surface 30 for a user to depress or actuate to disengage first and second anchors 14, 16 from body 12, as is described in detail below. Catch 26 includes an arm portion 32 and a head portion 34 coupled to arm portion 32. Arm portion 32 further includes a cut-out portion (not shown) for positioning an ejector spring 63, described in detail below, therein. Head portion 34 includes a shoulder or ridge 36, an angled surface 38, and a back surface 40, as shown in FIG. 5.

Figure 1:
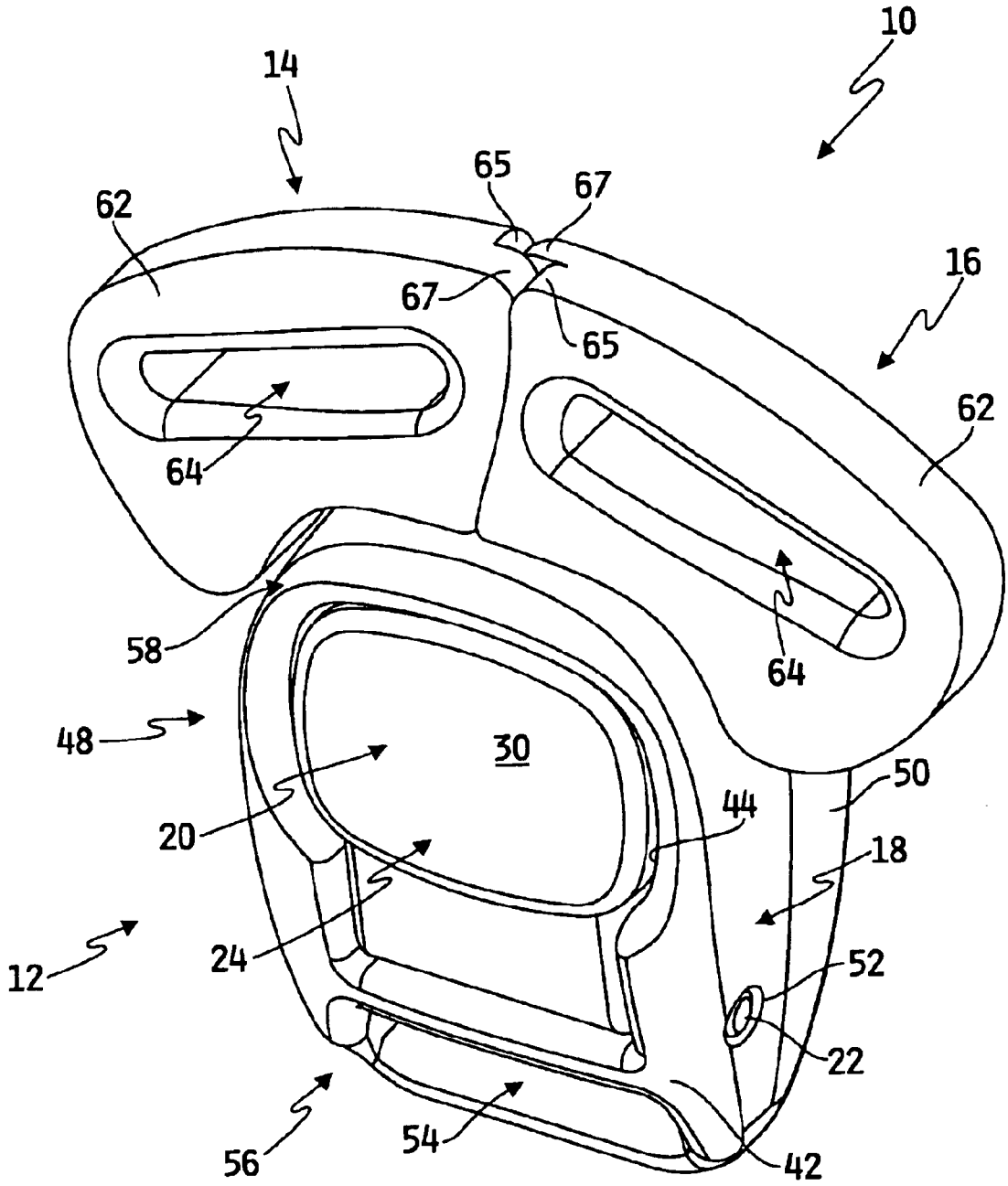
FIG. 1 is a perspective view of an illustrative infant buckle of the present disclosure for use with a juvenile harness-restraint system on a juvenile vehicle seat.
Figure 2:
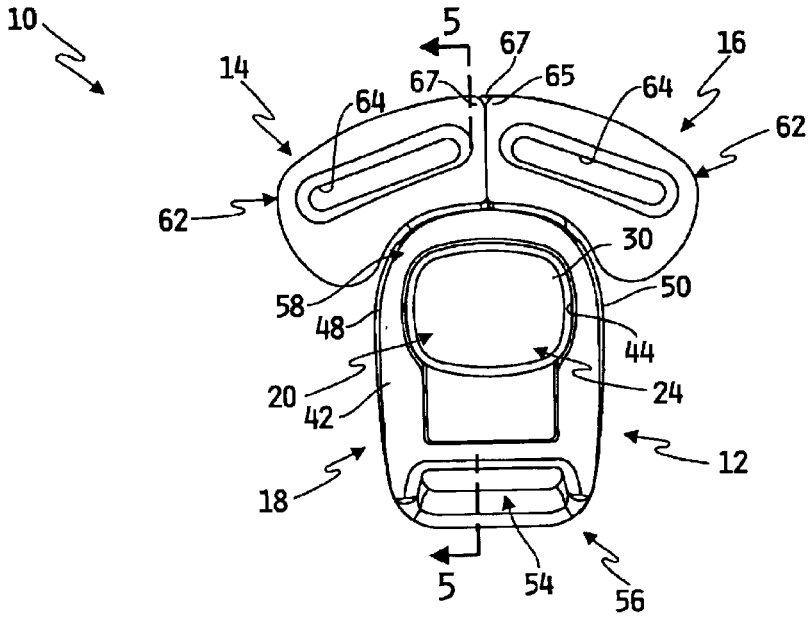
FIG. 2 is a top view of the buckle of FIG. 1 showing a body of the buckle including a belt-receiving aperture and further showing a first belt anchor and a second belt anchor of the buckle each coupled to the body.
Figure 3:
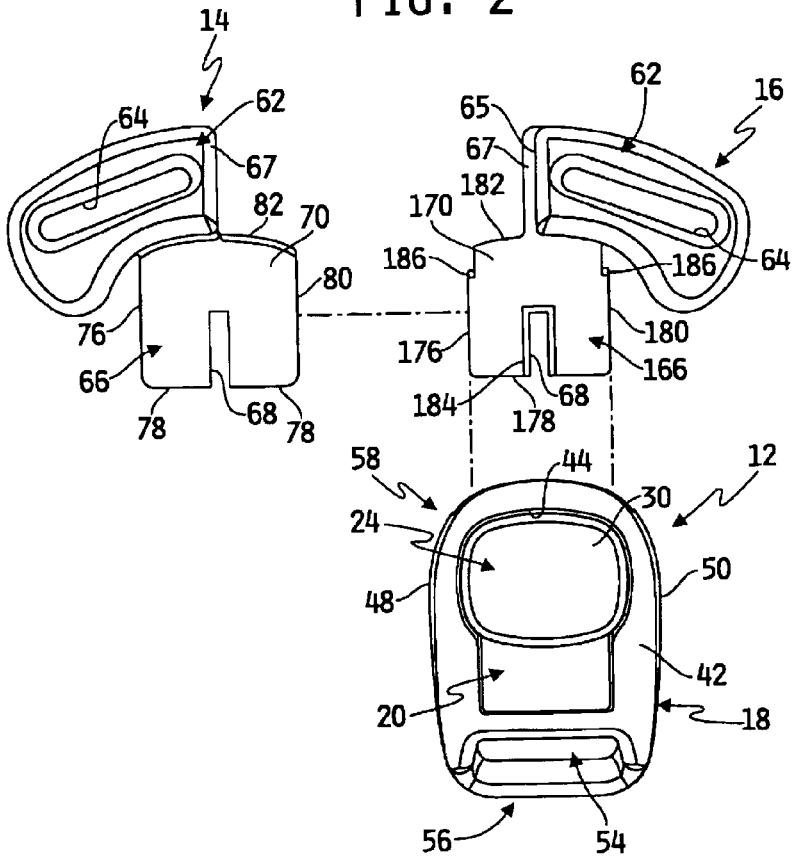
FIG. 3 is an exploded top view of the buckle showing the body and the first and second belt anchors detached from the body.
Figure 4:
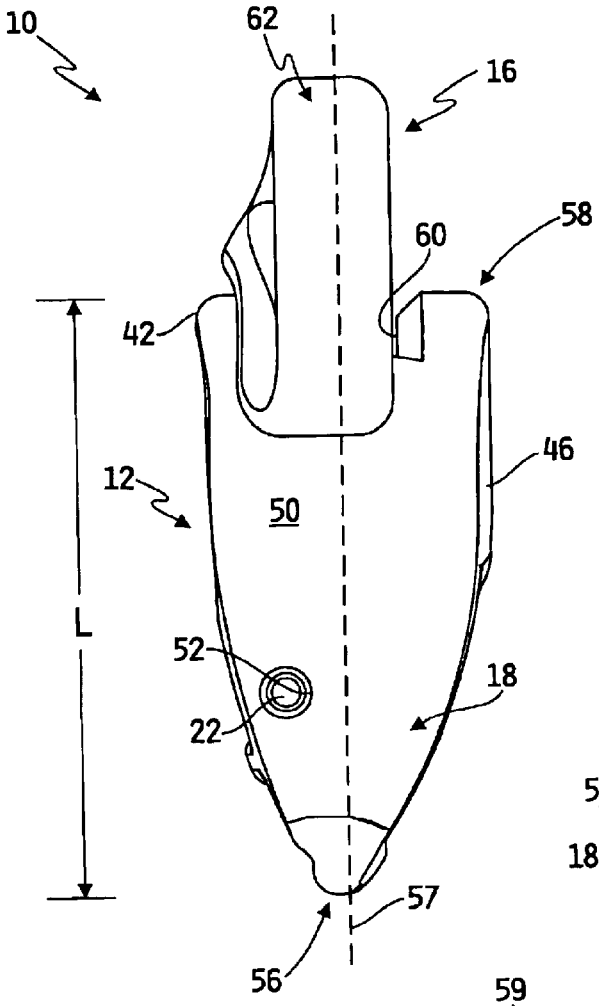
FIG. 4 is a side view of the buckle.

Housing 18 of buckle 10 includes a front wall 42 defining an actuator aperture 44, as shown in FIGS. 1–3, a back wall 46, as shown in FIGS. 4 and 5, and opposite side walls 48, 50. Each side wall 48, 50 is generally "V-shaped", as shown, for example, in FIG. 4. Further, each side wall 48, 50 is positioned between and coupled to front and back walls 42, 46. Aperture 52 is formed through each of the side surfaces 48, 50 and, as mentioned above, receives at least a portion of pin 22 therethrough.

Housing 18 further includes a belt-receiving aperture 54 through a bottom end 56 of housing 18. Aperture 54 normally receives a portion of a harness-restraint strap (not shown) therethrough. Such a harness-restraint strap is usually coupled to a seat bottom of the juvenile vehicle seat. Housing 18 further includes a top wall 58 defining an open mouth or insertion aperture 60 for receiving first and second belt anchors 14, 16 therein. A locking spring 61, shown in FIG. 5, is positioned within a cavity 92 formed within housing 18. Spring 61 includes a first end 94 adjacent housing 18 and a second end 96 adjacent back surface 40 of catch 26 to bias catch 26 in a direction away from back surface 46 of housing 18. As is discussed in greater detail below, locking spring 61 biases catch 26 to lock first and second belt anchors 14, 16 within cavity 92.

Body 12 further includes ejector spring 63 within housing 18 and positioned to lie along a longitudinal axis 57, shown in FIG. 5. Longitudinal axis 57 is generally perpendicular to a transverse axis 59 along which locking spring 61 lies. Longitudinal axis 57 is defined to extend from a back end or bottom portion 56 of buckle housing 18 to a front end or top portion 58 of buckle housing 18, as shown in FIGS. 4 and 5. Longitudinal axis 57 is further defined to lie along a length, L, of buckle housing 18. Ejector spring 63 is mounted onto a spring mount (not shown) of buckle 10, coupled to an inner surface 71 of housing 18, and includes a first end 97 adjacent inner surface 71 and a second end 98 engaged with a portion of first belt anchor 14 when buckle 10 is in the locked position. Although spring 63 is mounted on a spring mount, it is within the scope of this disclosure to include other means for mounting spring 63 within housing 18, such as providing a cavity for receiving at least a portion of spring 63, therein, for example. Ejector spring 63 biases first anchor 14 out of opening 60 to release buckle 10 to the unlocked position, as is described in more detail below.

Looking now to FIG. 3, first anchor 14 includes a belt coupler 62 forming a belt-receiving slot 64 for receiving a first shoulder-belt portion (not shown) of the child-restraint harness therethrough. As shown in FIG. 1, belt coupler 62 illustratively includes a notch 65 and an elongated detent 67. Notch 65 and detent 67 help to interlock first and second anchors 14, 16 to each other to place buckle in the locked position.

First anchor 14 further includes a tongue or tab portion 66 coupled to belt coupler 62. Tab portion 66 is generally square-shaped and includes an open-ended slot 68. Illustrative slot 68 is provided to receive a bight member (not shown) of actuator 20 extending between button 24 and catch 26 when first anchor 14 is received within opening 60 of housing 18, as is described in more detail below. Further, tab portion 66 includes a front surface 70, a back surface 72, and an outer lip 74 extending past back surface 72 in a direction away from front surface 70, as shown in FIG. 5. Outer lip 74 extends around a first, second, and third side 76, 78, 80 of tab portion 66. A portion of fourth or top side 82 is coupled to belt coupler 62. Outer lip 74 and back surface 72 define a recess 84 for receiving a portion of second anchor 16 therein when buckle 10 is in the locked position, as shown in FIG. 5 and described below.

Further illustratively, tab portion 66 includes a recessed ledge 86 formed in back surface 72 around slot 68. As mentioned above, ejector spring 63 is positioned generally about longitudinal axis 57 of the buckle 10. Thus, second end 98 of spring 63 generally engages second side 78 of outer lip 74 on both sides of slot 68 of tab portion 66, which is generally aligned with the longitudinal axis 57. It will be appreciated, however, that spring 63 could be positioned to either side of the longitudinal axis 57 of buckle 10 such that the spring 63 could engage side 78 of outer lip 74 on one or the other side of slot 68. In addition, the disclosure contemplates using two ejector springs, one on either side of the buckle's 10 longitudinal axis 57. Similarly, three springs could be used one each on either side of the longitudinal axis 57 and one positioned along the longitudinal axis 57.

Second belt anchor 16 is similar to first anchor 14 and as such, like reference numerals are used for similar features. Similar to first anchor 14, second anchor 16 includes belt coupler 62 with belt-receiving slot 64. Further, belt coupler 62 includes notch 65 and detent 67, as shown in FIGS. 1 and 3. Notch 65 and detent 67 of second anchor 16 are formed to interlock with notch 65 and detent 67 of first anchor 14, as shown in FIG. 1. Therefore, notch 65 of first anchor 14 receives detent 67 of second anchor and notch 65 of second anchor receives detent 67 of first anchor when first and second anchors 14, 16 are coupled to each other.

Second anchor 16 also illustratively includes a similar, but different, tab portion 166. Tab portion 166 is formed to be received within recess 84 of tab portion 66, as shown in FIG. 5, when first and second anchors 14, 16 are coupled to each other. Tab portion 166 includes slot 68, a first side 176, a second side 178, a third side 180, and a fourth side 182. Tab portion 166 further includes a front surface 170 normally positioned to lie adjacent a back surface 88 of tab portion 66, as shown in FIG. 5, when buckle 10 is in the locked position. Tab portion 166 further includes a raised ridge 186 (shown in FIG. 3) around slot 68 which protrudes outwardly from front surface 170. Ridge 186 is received within recessed ledge 86 of tab portion 66, as shown in FIG. 5. Tab portion 166 further includes notches 186 cut out from each of the first and second sides 176, 180. Each notch 186 abuts a shoulder (not shown) formed within the outer lip 74 of tab portion 166.

Looking now to FIG. 5, tab portion 166 includes a generally flat back surface 188 and a wedge 190 extending outwardly from back surface 188. Wedge 190 includes an angled camming surface 192 and end surface 194. When buckle 10 is in the locked position, end surface 194 abuts ridge 36 of head portion 34 of catch 26.

In operation, first and second anchors 14, 16 are coupled to each other by placing tab portion 166 of second anchor 16 within recess 84 of tab portion 66 so that ridge 184 of tab portion 166 is received within recess 86 of tab portion 66 and so that the detents 67 of each respective belt coupler 62 fit within notches 65 of the opposing belt coupler 62 to abut each other. Next, the tab portions 66, 166 of first and second anchors 14, 16 are inserted into cavity 92 through opening 60 of housing 18 so that camming surface 192 of tab portion 166 cams against angled surface 38 of catch 26 against the bias of locking spring 61. Tab portions 66, 166 are inserted until camming surface 192 passes angled surface 38 and spring 61 biases catch 26 in a direction toward tab portion 166 so that ridge 36 and end surface 194 abut each other. As shown in FIG. 5, spring 61 biases catch 26 to maintain tab portions 66, 166 within cavity 92 of housing 18 so that buckle 10 is normally maintained in the locked position when tab portions 66, 166 are inserted sufficiently into opening 60. As mentioned above, pin 22 extends through actuator 20 and housing 18 so that as catch 26 is pressed against the bias of spring 61, actuator 20 rotates about pin 22 in a clockwise direction as viewed in FIG. 5. Spring 61 normally acts against catch 26 to urge actuator 20 to rotate in a counter-clockwise direction about pin 22. Further, as tab portions 66, 166 are inserted into opening 60, end surface 90 of outer lip 74 engages second end 98 of spring 63 and acts to compress spring 63 against its bias.

To release first and second anchors 14, 16 from opening 60, a user depresses button 24 to move actuator 20 about pin 22 in a clockwise direction so that back surface 40 of catch 26 acts against the bias of spring 61. As catch 26 is moved away from tab portion 166, ridge 36 of head portion 34 disengages end surface 194 of tab portion 166 to allow first and second anchors 14, 16 to move relative to catch 26. Once tab portion 166 is disengaged from catch 26, ejector spring 63, acting on end 90 of outer lip 74, urges tab portions 66, 166 out of opening 60 so that the buckle 10 is in the unlocked position.

It will be appreciated that spring 63, as an aid to urge the anchors 14, 16 out of opening 60, could be eliminated from the buckle 10. For example, in such a buckle 10 without spring 63, the anchors 14, 16 could be pulled out of opening 60 by a user after the user depresses button 24 to disengage the catch 26 as just described.

Figure 6:
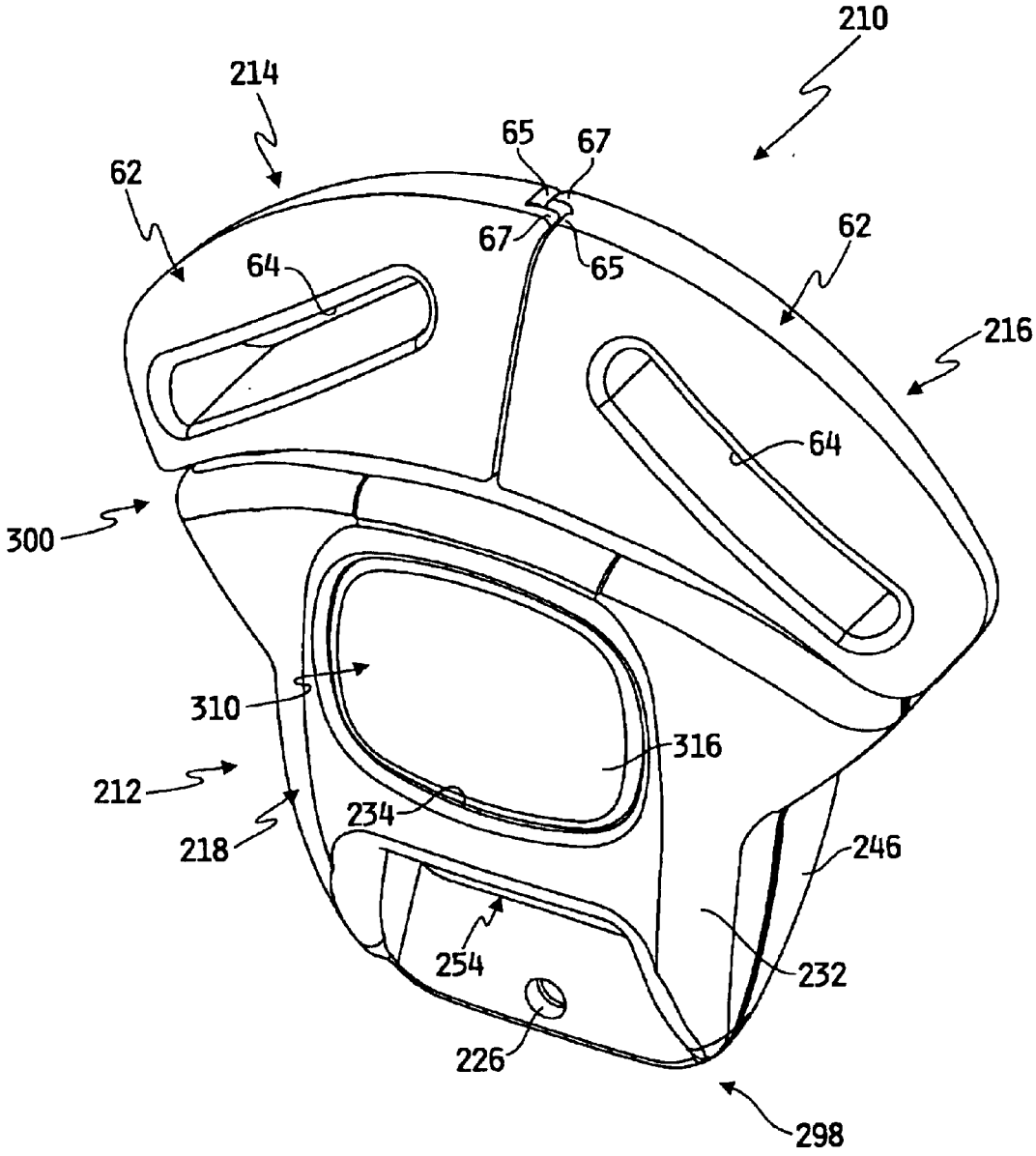
FIG. 6 is a perspective view of an alternative infant buckle of the present disclosure.

Looking now to FIGS. 6–9, an alternative infant buckle 210 is provided. Infant buckle 210 is similar in design and operation to infant buckle 10, shown in FIGS. 1–5. Illustrative buckle 210 is similarly movable by a user between locked and unlocked positions. Illustrative buckle 210 includes a body 212, a first belt anchor 214 and a second belt anchor 216, as shown in FIG. 6. First and second belt anchors 214, 216 are coupled to each other and to body 212 when buckle 210 is in the locked position.

Figure 7:
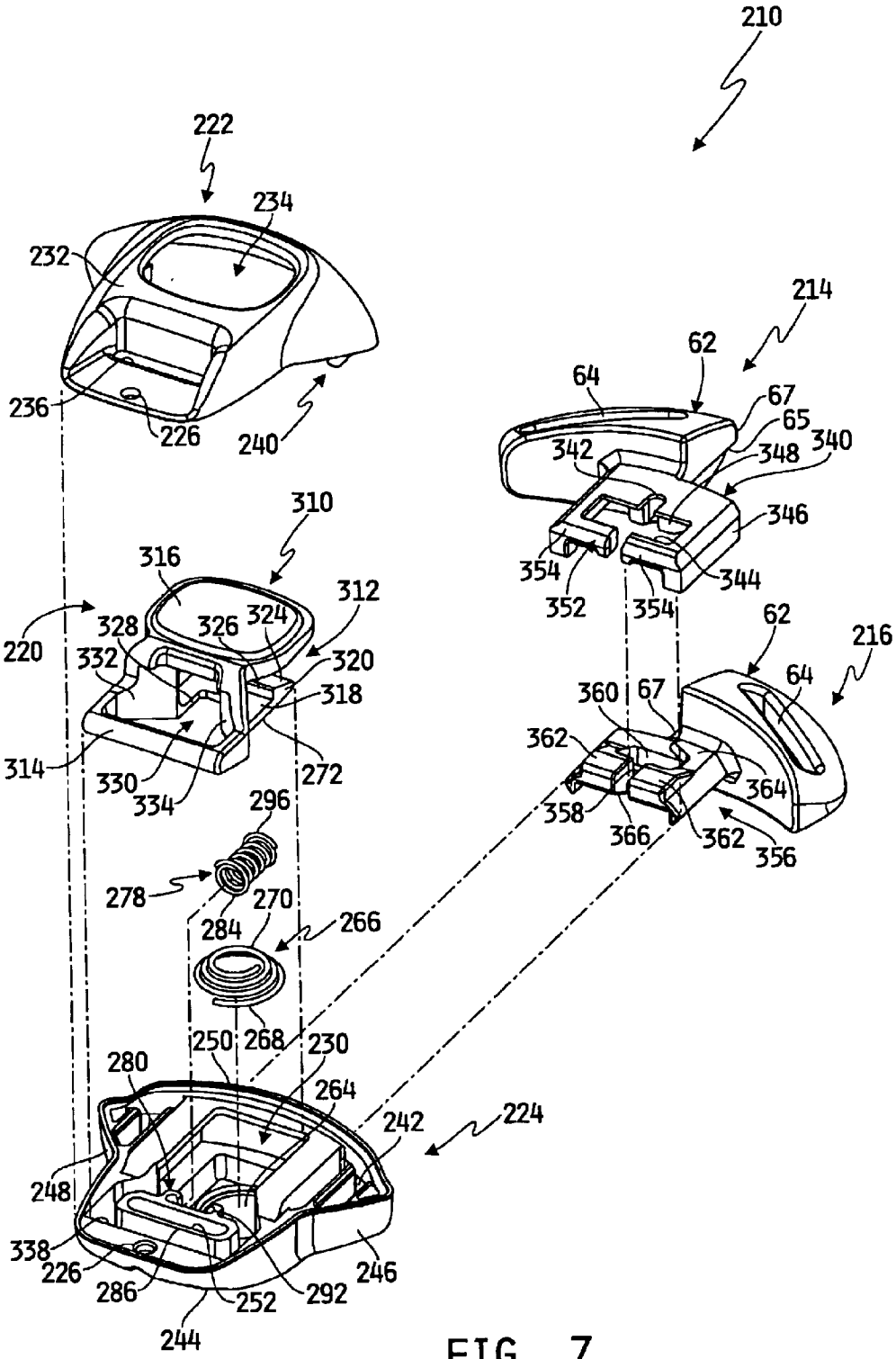
FIG. 7 is an exploded, perspective view of the buckle of FIG. 6 showing a first and second belt anchor, an actuator, top and bottom halves of a buckle housing, and a locking spring, and an ejector spring.

As shown in FIG. 7, body 212 includes a buckle housing 218 and an actuator 220 coupled to housing 218 for movement relative to housing 218. Illustrative housing 218 includes a top housing member 222 and a bottom housing member 224 coupled to the top housing member 222 by a pin or rivet (not shown) through a pin hole 226 of top and bottom housing members 222, 224.

Top and bottom housing members 222, 224 cooperate to define an inner cavity 230 of housing 218. Actuator 220 is received within cavity 230 for movement relative to housing 218 between locked and unlocked positions. Top housing member 222 includes a top wall 232 formed to define an actuator aperture 234. Top housing member 222 is also formed to define a belt-receiving aperture 236 formed to receive a portion of a safety-belt (not shown) therethrough. Tabs 240 are coupled to an inside surface of top housing member 222 and depend from an inside surface of top housing member 222. Illustrative tabs 240 are provided to be received within corresponding apertures 242 of bottom housing member 224 to align and couple top housing member 222 with bottom housing member 224.

Bottom housing member 224 includes a bottom wall 244, opposite side walls 246, 248 spaced-apart from each other and coupled to bottom wall 244, and a front wall 250 coupled to bottom and side walls 244, 246, 248. A belt-receiving aperture 252 is formed through bottom wall 244. Aperture 252 aligns with aperture 236 of top housing member 222 to form a belt-receiving opening 254 of housing 218. Bottom, side, and front walls 244, 246, 248, 250 cooperate to define cavity 230 for receiving actuator 220 therein. Top housing member 222 cooperates with bottom housing member 224 to cover and enclose cavity 230 to maintain actuator 220 within cavity 230.

Front wall 250 of bottom housing member 224 is formed to define an insertion opening 260 formed to receive a portion of the first and second belt anchors therein 214, 216. Apertures 242 for receiving the tab members 240 of top housing portion 222 are formed through front wall 250 as well. Illustratively, insertion opening 260 is positioned between the two apertures 242.

Figure 9:
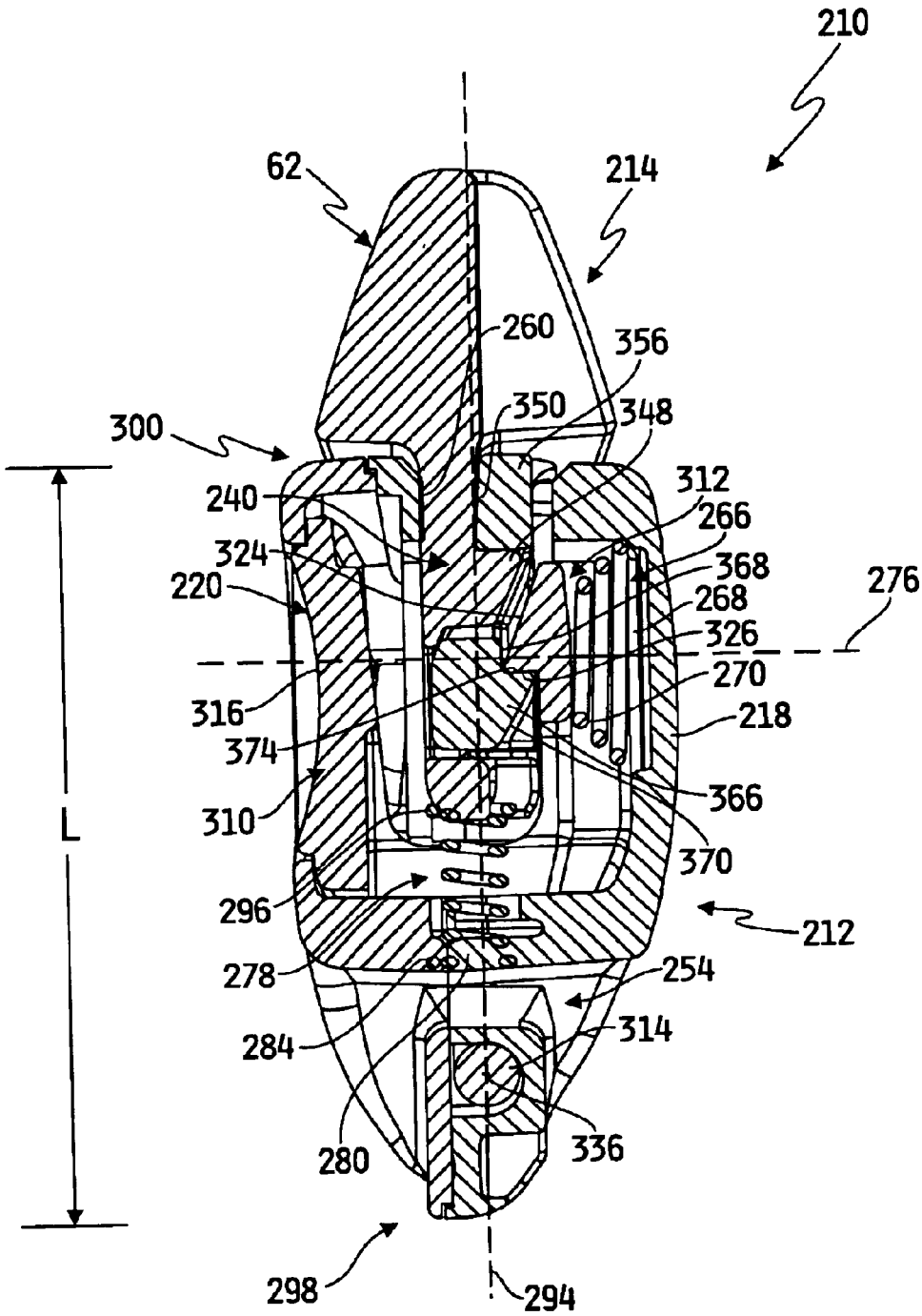
FIG. 9 is a sectional view of the buckle of FIGS. 6–8 taken along line 9—9 of FIG. 8 showing the locking spring engaged with the actuator and showing the ejector spring engaged with one of the belt anchors.

An inner surface 262 of bottom wall 244 includes a recessed area or cavity 264 formed to receive a locking spring 266 of infant buckle 210, as shown in FIGS. 7 and 9. Locking spring 266, similar to locking spring 61 of infant buckle 10, includes a first end 268 adjacent inner surface 262 of bottom wall 244 of buckle housing 218 and a second end 270 adjacent actuator 220. As is discussed in more detail below, second end 270 of first spring 266 engages a back surface 272 of a belt-anchor catch 312 of actuator 220 to bias catch 312 in a direction away from inner surface 262 of buckle housing 218. Spring 266 is positioned to lie along a transverse axis 276, as shown in FIG. 9, and acts to bias catch 312 along transverse axis 276.

Infant buckle 210 further includes an ejector spring 278, similar to spring 63 of infant buckle 10, positioned within buckle housing 218. Spring 278 is formed to be received within a spring mount 280 of bottom housing member 224 of buckle housing 218, as shown in FIG. 7. Spring mount 280 is formed to define a slot 282 for receiving a first end 284 of spring 278 therein. Illustratively, spring mount 280 is coupled to an interior wall 286 defining belt-receiving aperture 252. Spring mount 280 includes a portion of wall 286, a front wall 288 coupled to wall 286 and having a "U-shaped" cut-out 290, and opposite side walls or rims 292 coupled to wall 286 and front wall 288 to form slot 282 for receiving spring 278. Illustratively, ejector spring 278 is positioned to lie along a longitudinal axis 294, as shown in FIG. 9, generally perpendicular to transverse axis 276 along which locking spring 266 lies. Similar to longitudinal axis 57 of infant buckle 10, longitudinal axis 294 is defined to extend from a bottom portion 298 of buckle housing 218 to a top portion 300 of buckle housing 218. Similarly, longitudinal axis 294 lies along a length, L, of buckle housing 218, as shown in FIG. 9, for example. Further, longitudinal axis 294 is a central axis positioned to lie along the center of infant buckle 210. Longitudinal axis 266 is positioned substantially equidistant between side walls 246, 248 of infant buckle 210. Thus, ejector spring 278 is centrally positioned between side walls 246, 248 of infant buckle 210. As is discussed in greater detail below, a second end 296 of spring 278 is positioned to engage a portion of first belt anchor 214 when first belt anchor 214 is received within insertion opening 260 of bottom housing member 224.

Actuator 220 as discussed above, is received within cavity 230 of buckle housing 218 for movement relative to buckle housing 218 between locked and unlocked positions. Locking spring 266 biases actuator 220 to the locked position to retain first and second belt anchors 214, 216 within cavity 230. Illustratively, as shown in FIGS. 7 and 9, actuator 220 is monolithic and includes an upper button 310, a lower catch 312 coupled to upper button 310, and a pivot appendage or arm 314 coupled to both upper button 310 and lower catch portion 312. Upper button 310 includes an indented upper surface 316 accessible through actuator aperture 234 of top housing member 222, as shown in FIG. 7, for a user to depress or actuate to disengage first and second anchors 214, 216 from within cavity 230 of buckle housing 218.

Catch 312 of actuator 220 includes an arm portion 318 and a head portion 320 coupled to arm portion 318. Catch 312 of actuator 220 is spaced-apart from button 310, but is coupled to button 310 by a bight member (not shown) which extends between button 310 and catch 312 to interconnect button 310 and catch 312. Illustrative bight member (not shown) is centrally located across actuator 320 to lie along longitudinal axis 294. Head portion 320 of catch 312 includes an inclined cam surface 324 and a ridge or shoulder 326. As is discussed in more detail below, ridge 326 engages second belt anchor 216 to lock first and second belt anchors 214, 216 within cavity 230 of buckle housing 218. Arm portion 318 of catch 312 includes a cut-out portion 328 formed to receive a portion of ejector spring 278 therein. Particularly, actuator 220 is formed to define a cavity 330 for receiving a portion of the spring 278 therein. Cut-out portion 328 of arm portion 318 is in communication with cavity 330.

Figure 8:
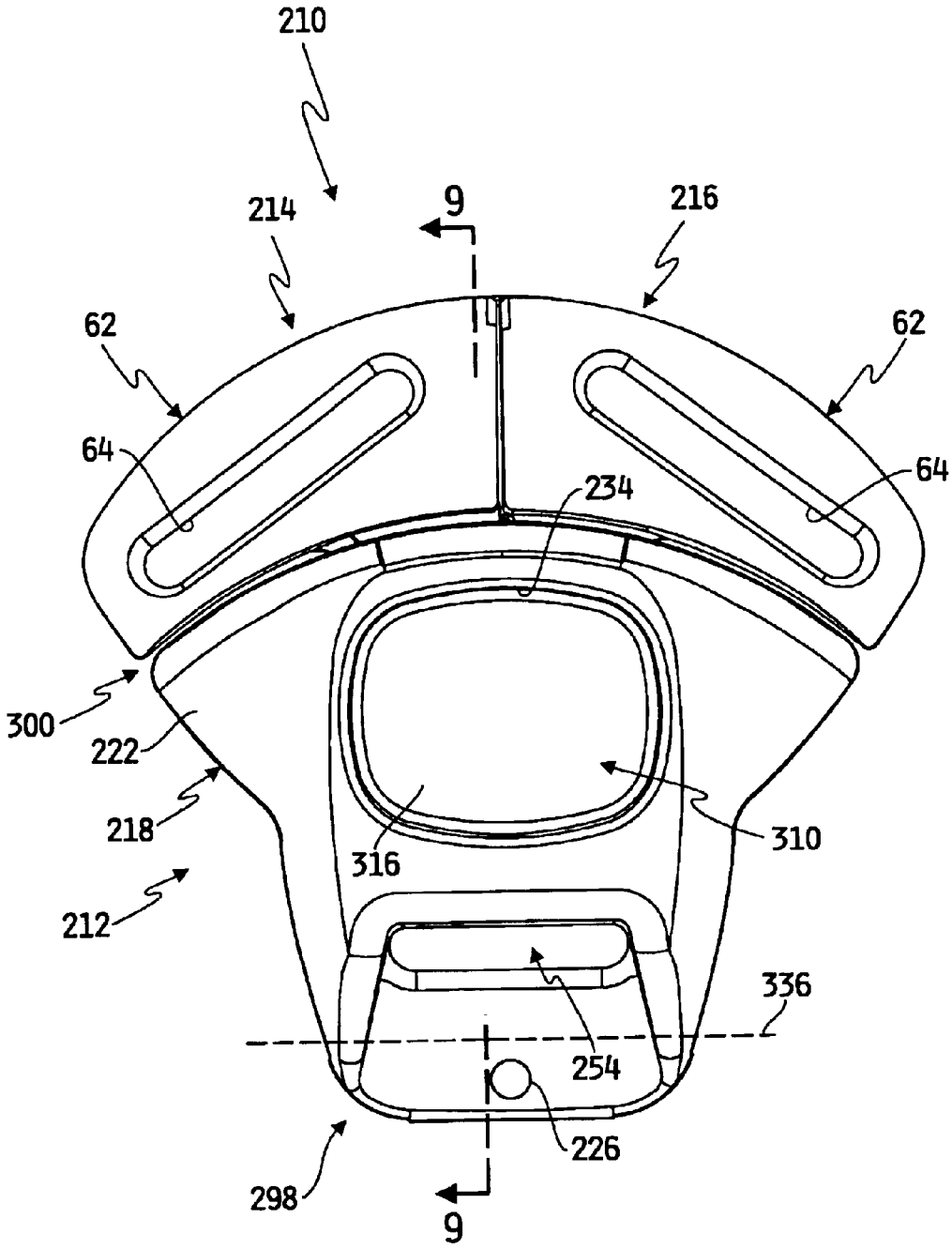
FIG. 8 is a top view of the buckle of FIGS. 6 and 7.

Pivot arm 314 of actuator 220 is coupled to both button 310 and catch 312 by a pair of spaced-apart arms 332, 334. Spaced-apart arms 332, 334 cooperate to define a portion of the cavity 330 formed to receive spring 278 therein. Pivot arm 314 is rigidly coupled to button 310 and catch 312 to move therewith as button 310 is depressed by a user to unlock buckle 210, for example. Pivot arm 314 defines a pivot axis 336, as shown in FIGS. 8 and 9, which is perpendicular to both transverse and longitudinal axes 276, 294 described above. Actuator 220 pivots about pivot axis 336 when button 310 is depressed or actuated by the user.

Illustratively, pivot arm 314 is posited within a pivot arm slot 338 formed within the bottom housing member 224, as shown in FIG. 7. Further illustratively, pivot arm slot 338, and thus pivot arm 314, are positioned behind belt-receiving aperture 252 of bottom housing member 224. Pivot arm 214, and thus actuator 220, are secured within buckle housing 18 by way of top housing member 222. Top housing member 222 acts to cover slot 338 to limit movement of actuator 220 to pivoting movement about pivot axis 336. Cavity 230 of buckle housing 218 provides sufficient room to allow button 310 and catch 312 of actuator 220 to move about pivot axis 336.

Looking now to FIGS. 6 and 7, first belt anchor 214 and second belt anchor 216, similar to first belt anchor 14 and second belt anchor 16 of infant buckle 10, each includes belt-coupler 62 having a belt-receiving slot 64 for receiving a first shoulder-belt portion (not shown) of the child-restraint harness therethrough. As shown in FIG. 7, belt coupler 62 illustratively includes notch 65 and elongated detent 67 which cooperate with a corresponding notch 65 and detent 67 to help interlock first and second belt anchors 214, 216 to each other to prior to inserting belt anchors 214, 216 into buckle housing 218.

First belt anchor 214 further includes a tab portion 340 coupled to belt coupler 62. Tab portion 340 is generally square-shaped and includes an open-ended slot 342 and a cut-out portion 344 in communication with slot 242. Illustrative slot 342 is provided to receive bight member (not shown) therein when first anchor 214 is received within insertion opening 260 of buckle housing 218, as is described above with respect to infant buckle 10. Side walls 346 of tab portion 340 define an area for receiving a portion of second belt anchor 216 therein. A ridge 348 is coupled to a rear surface 350 of tab portion 340. As is discussed in greater detail below, a front or leading end 352 of tab portion 340 engages ejector spring 278 when first belt anchor 214 is inserted into insertion opening 360. Particularly, slot 64 separates front end 352 into two separate front end portions 254. Illustrative slot 278 is generally aligned with longitudinal axis 294 when belt anchor 214 is inserted into buckle housing 18. Thus, second end 296 of spring 278 generally engages first and second portions 254 of front end 252. It will be appreciated, however, that spring 278 may be positioned to either side of the longitudinal axis 294 of buckle 210 such that spring 278 may engage either first or second portions 254 of front end 252. In addition, the disclosure contemplates using two springs, one on either side of the buckle's longitudinal axis 294. Similarly, it is within the scope of this disclosure to include three springs for biasing the first and second belt anchors 214, 216 in a direction out of insertion opening 260 such that one spring may be positioned on either side of longitudinal axis 294 and one spring may be positioned along the longitudinal axis 294.

In addition to belt coupler 62, second anchor 216 also includes a similar, but different, tab portion 356. Tab portion 356 is formed to be received within a recess or area of tab portion 340 of first belt anchor 214 to lie adjacent to tab portion 356. Tab portion 356 includes an open-ended slot 358 and a cut-out portion 360 in communication with slot 358. When tab portions 340, 356 are coupled to each other, slot 342 of tab portion 340 and slot 358 of tab portion 356 are aligned with each other to receive at least a portion of bight member (not shown) therein, as discussed above. Cut-out portion 360 of tab portion 356 is formed to receive ridge 348 of tab portion 340 to interlock tab portions 340, 356 together. Tab portion 356 further includes raised detents 362 coupled to a top surface 364 of tab portion 356 to be received within cut-out portion 344 of tab portion 340 when first and second belt anchors 214, 216 are coupled to each other.

Tab portion 356 of second belt anchor 216 further includes a catch 366 coupled to a bottom surface 368 of tab portion 358. Catch 366 includes an inclined cam surface 370 and an end surface 374. When infant buckle 210 is in the locked position and first and second belt anchors 214, 216 are received within insertion opening 260, end surface 374 of catch 366 of second belt anchor 216 abuts ridge 326 of head portion 320 of catch 312 of actuator 220.

Illustrative buckle 210 operates in the same manner as buckle 10. First and second belt anchors 214, 216 are coupled to each other as discussed above. Next, the tab portions 340, 356 of first and second belt anchors 214, 216 are inserted within insertion opening 260 of housing 218 so that cam surface 370 of tab portion 356 cams against angled surface 324 of catch 312 to pivot actuator 220 in a clockwise direction about pivot axis 336 to move catch 312 in a direction against the bias of locking spring 266.

Tab portions 340, 356 are inserted through insertion opening 260 and into cavity 230 until cam surface 370 passes angled surface 324 and spring 266 biases catch 312 in a direction toward tab portion 356 so that end surface 374 and ridge 326 abut each other. As shown in FIG. 9, spring 266 biases catch 312 to maintain tab portions 340, 356 coupled to catch 312 within cavity 230 of housing 218 so that buckle 210 is maintained in the locked position when tab portions 340, 356 are inserted sufficiently into cavity 230 through opening 260. Spring 266 normally acts against catch 312 to urge actuator 220 to rotate in a counter-clockwise direction about pivot axis 336. As mentioned above, pivot arm 314 is rigidly coupled to button 310 and catch 312 and thus pivots about pivot axis 336 with button 310 and catch 312.

As tab portions 340, 356 are inserted through insertion opening 260 and into cavity 230, leading end 352 of tab portion 340 of first belt anchor 214 engages second end 296 of ejector spring 278 to compress second spring 278 against its bias. Specifically, portions 354 of leading edge 352 positioned to either side of slot 282, each engage spring 278.

To unlock infant buckle 210 and release first and second belt anchors 214, 216 from within cavity 230, a user depresses button 310 to move actuator 220 about pivot axis 336 in a clockwise direction so that back surface 272 of catch 312 acts against the bias of locking spring 266. As catch 312 is moved away from tab portion 356, ridge 326 of head portion 320 disengages end surface 374 of tab portion 356 to allow first and second belt anchors 214, 216 to move relative to catch 312. Once tab portion 356 is disengaged from catch 312, ejector spring 278, acting against left and right portions 354 of leading end 352 of tab portion 340, urges tab portions 340, 356 out of cavity 230 through insertion opening 260 so that the buckle 210 is in the unlocked position.

The illustrative components of buckles 10, 210 generally are made of plastic. Illustratively, the buckle housing could comprise a single piece of molded plastic, as illustrated by housing 18, for example. Alternatively, the buckle housing could comprise two or more pieces coupled together, as illustrated by housing 218, for example. Those skilled in the art will appreciate, though, that other suitable materials or composite materials may be used alone or in combination with plastic or one another. For example, and without limitation, graphite, steel, zinc, or aluminum may be used.

Finally, although buckles 10, 210 have been described for use with child restraint systems, such description is illustrative in nature only. Buckles 10, 210 are adaptable for use, for example, with a pet restraint system, with a backpack system, or with a luggage tie-down system or other systems.

Although the several disclosures have been described in detail with reference to certain embodiments, variations and modifications exist within the scope and spirit of the disclosure and such are desired to be protected.

What is claimed is:

1. A buckle for use with a safety belt comprising a buckle housing formed to define a cavity, an actuator aperture in communication with the cavity, and an insertion opening in communication with the cavity, an actuator coupled to the buckle housing and formed to include a button accessible through the actuator aperture of the buckle housing and a belt-anchor catch coupled to the button to move with the button, an ejector spring positioned within the cavity of the buckle housing along a substantially central longitudinal axis defined to extend from a back end of the buckle housing to a front end of the buckle housing, a locking spring positioned within the cavity of the buckle housing along a transverse axis substantially perpendicular to the longitudinal axis and formed to engage a bottom wall of the buckle housing at a first end and a portion of the belt-anchor catch at a second end to bias the belt-anchor catch in a direction away from the bottom wall of the buckle housing, a first belt anchor formed to be inserted, at least in part, into the insertion opening to engage the ejector spring and move the ejector spring to a retracted position, and a second belt anchor coupled to the first belt anchor and formed to be inserted, at least in part, into the insertion opening to engage the belt-anchor catch of the actuator and move the belt-anchor catch of the actuator against the bias of the locking spring.

2. The buckle of claim 1, wherein the actuator comprises a bight member coupled to and positioned to extend between the button and the belt-anchor catch and wherein the ejector spring is aligned with the bight member along the longitudinal axis.

3. The buckle of claim 2, wherein the belt-anchor catch comprises an arm portion and a head portion coupled to the arm portion, and wherein the arm portion includes a cut-out portion formed to receive, at least in part, the ejector spring therein.

4. The buckle of claim 1, wherein the actuator comprises a pivot arm coupled to the button and the catch such that the actuator, including the pivot arm, catch, and button, is a monolithic member, and further wherein the pivot arm is formed to define a pivot axis about which the actuator pivots.

5. The buckle of claim 4, wherein the buckle housing further comprises a belt-receiving aperture configured to receive a portion of a safety belt therethrough, and wherein the arm of the actuator is positioned between the back end of the buckle housing and the belt-receiving aperture.

6. The buckle of claim 1, wherein the ejector spring is a coil spring and the locking spring is a coil spring.

7. The buckle of claim 6, wherein the buckle comprises a spring mount and the ejector spring is mounted to the spring mount.

8. The buckle of claim 6, wherein the buckle housing comprises a recess formed in the bottom wall and the locking spring is received, at least in part, within the recess.

9. The buckle of claim 1, wherein the first belt anchor comprises a tongue formed to include a front end having a right end portion and a left end portion spaced-apart from the right end portion, and wherein the right and left end portions engage the ejector spring when the first belt anchor is positioned within the cavity of the buckle housing.

10. A buckle for use with a safety belt comprising a buckle housing formed to define an actuator aperture, an insertion aperture, and an interior cavity in communication with the actuator aperture and the insertion aperture, an actuator positioned within the interior cavity of the buckle housing and formed to include a button positioned, at least in part, within the actuator aperture, a belt-anchor catch coupled to the button, and a pivot arm coupled to the button and the belt-anchor catch for movement about a pivot axis with the button and belt-anchor catch, an ejector spring having a first end coupled to the buckle housing and a second end configured to and which engages a belt anchor of the buckle in the locked position.

11. The buckle of claim 10, wherein the belt-anchor catch of the actuator defines an opening formed to receive at least a portion of the ejector spring therein.

12. The buckle of claim 11, wherein the ejector spring is positioned to lie along a longitudinal axis substantially centrally located between spaced-apart side walls of the buckle housing.

13. The buckle of claim 12, wherein the actuator further comprises a bight member coupled to and positioned to extend between the button and the belt-anchor catch and wherein the bight member is aligned with the ejector spring.

14. The buckle of claim 10, wherein the buckle housing further comprises a spring mount and the ejector spring is coupled to the spring mount.

15. The buckle of claim 10, wherein the buckle housing further comprises a belt-receiving opening configured to receive a portion of the safety belt therein and wherein the belt-receiving opening is positioned between the pivot arm of the actuator and the actuator opening.

16. The buckle of claim 10, further comprising a locking spring positioned within the cavity of the buckle housing between a bottom wall of the buckle housing and the belt-anchor catch of the actuator and wherein the locking spring is a coil spring.

17. The buckle of claim 10, further comprises a first belt anchor having a front end engaged with the ejector spring in a locked position and a second belt anchor coupled to the first belt anchor and engaged with the belt-anchor catch of the actuator in the locked position to couple the first and second belt anchors to the buckle housing.

18. A buckle comprising a buckle housing having an insertion opening configured to receive a belt anchor therein and an actuator opening, an actuator positioned within a cavity of the buckle housing and formed to include a button accessible to a user through the actuator opening, a belt-anchor catch coupled to the button, and a pivot arm coupled to the button and the belt-anchor catch and formed to define a pivot axis along a length of the pivot arm, the pivot arm being spaced apart from the button and the belt-anchor catch to form a spring-receiving space between the pivot arm, button, and belt-anchor catch, an ejector spring coupled to a spring mount of the buckle housing and positioned to lie within the spring-receiving space of the actuator, and a locking spring positioned between and engaged with the buckle housing and the belt-anchor catch.

19. The buckle of claim 18, further comprising a belt anchor formed to lockingly engage the belt-anchor catch and bias the belt-anchor catch in a direction against the bias of the locking spring.

20. The buckle of claim 18, wherein ejector spring is positioned to lie along a central, longitudinal axis of the buckle housing formed to extend along a length of the buckle housing.

* * * * *